United States Patent [19]

McCorquodale

[11] Patent Number: 4,624,219

[45] Date of Patent: Nov. 25, 1986

[54] HOT WATER APPARATUS

[76] Inventor: Alan B. McCorquodale, 1912 Link Ave., Orange, Tex. 77630

[21] Appl. No.: 818,050

[22] Filed: Jan. 13, 1986

[51] Int. Cl.[4] ..... F22B 7/04

[52] U.S. Cl. ..... 122/170; 122/19; 122/172; 122/250 R; 236/20 R

[58] Field of Search ..... 122/13 R, 14, 18–19, 122/135 R, 155 R, 156, 166 R, 167–170, 172, 183, 247, 249, 250 R, 250 S, 251, 321–322, 332–333, 338–339, 360, 448 R, 451.1; 236/20 R; 126/350 R, 361, 374, 392

[56] References Cited

U.S. PATENT DOCUMENTS

| | | | |
|---|---|---|---|
| 1,469,805 | 10/1923 | Musselman | 122/250 R |
| 1,901,761 | 3/1933 | McCorquodale | 236/20 R |
| 2,056,989 | 10/1936 | Strong | 122/19 |
| 2,089,734 | 8/1937 | Czeschin | 122/18 |
| 2,592,863 | 4/1952 | Conner | 122/13 R |
| 2,974,650 | 3/1961 | McCorquodale | 122/494 |
| 3,320,935 | 5/1967 | McCorquodale | 122/494 |

*Primary Examiner*—Albert J. Makay
*Assistant Examiner*—Steven E. Warner
*Attorney, Agent, or Firm*—Dodge, Bush & Moseley

[57] ABSTRACT

An instantaneous demand gas fired hot water heater apparatus having the water temperature sensing thermostat disposed in the upper hot water outlet header with the inlet flow of unheated water directed to flow in a preferred flow path across the temperature sensing element. The temperature sensing element location in the upper header of the heater provides an extremely sensitive and efficient burner control. Upon initial output demand of hot water the lower temperature of the unheated water is immediately sensed by the temperature sensing element to immediately commence burner operation. Upon termination of heater water demand, the heated water temperature is rapidly sensed by the temperature sensing element to promptly terminate the supply of the gas to the burner and minimize unnecessary heating of the water.

6 Claims, 1 Drawing Figure

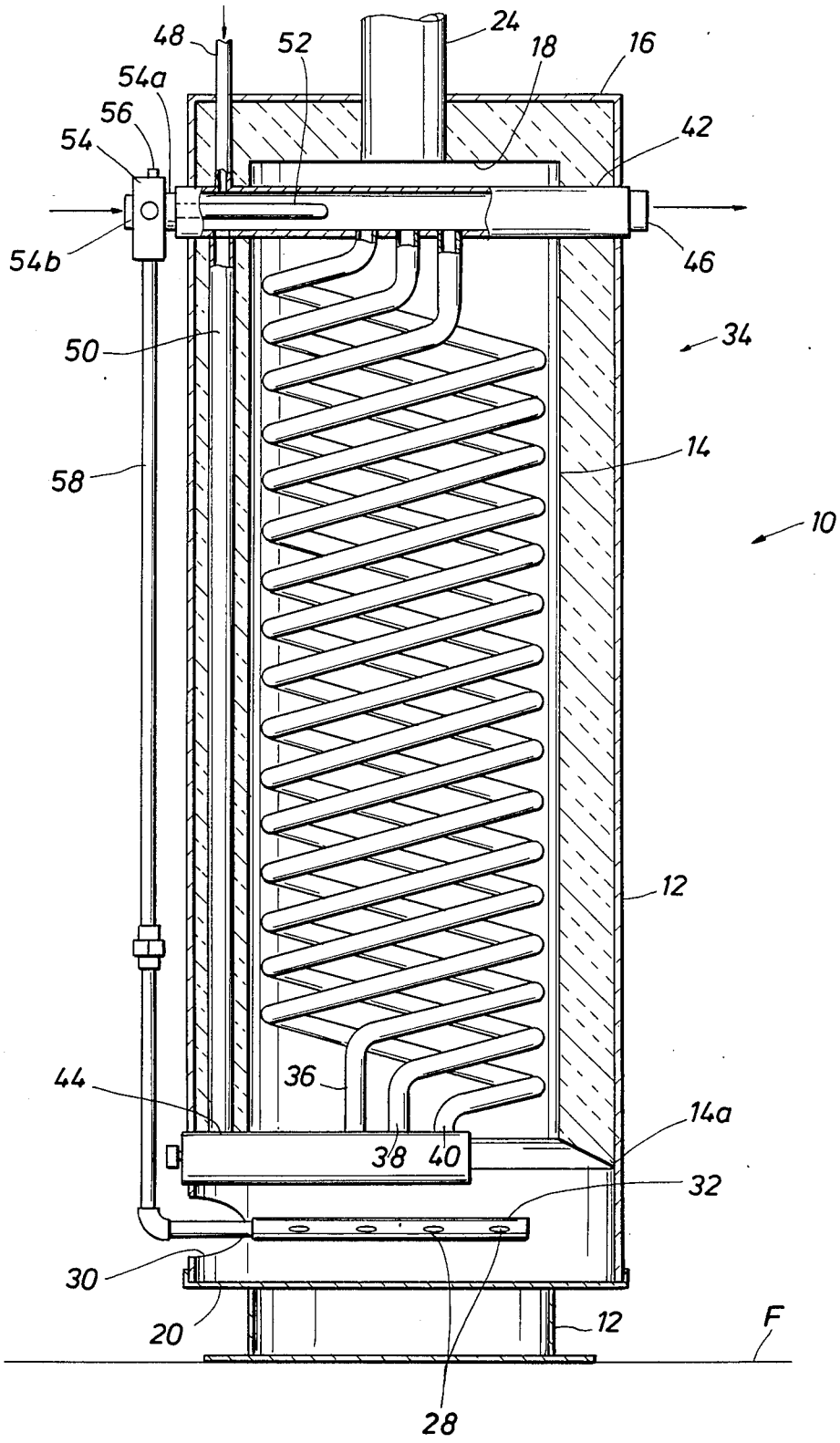
48
52
24
18
16
54a
56
54
42
54b
46
50
34
58
14
10
12
44
36
14a
38
40
32
30
20
12
F
28

HOT WATER APPARATUS

BACKGROUND OF THE INVENTION

1. Field of the Invention

The field of the present invention relates generally to hot water heaters and more particularly to instantaneous demand hot water heaters.

2. Background Art

The present inventor is familiar with the following three U.S. patents which are hereby fully incorporated herein for all purposes by this specific reference:

| U.S. Pat. No. | Inventor |
|---|---|
| 1,901,761 | Wilmer E. McCorquodale |
| 2,974,650 | Alan B. McCorquodale |
| 3,320,935 | Alan B. McCorquodale |

By instantaneous demand is meant a hot water heater that provides an output of heated water in response to user demand. The water is heated while flowing through coils or tubes rather than heating a tank or reservoir filled with water as in conventional household water heaters. The latter arrangement is relatively inefficient in use of energy in requiring the heating and maintaining a large volume of water in heated readiness. In addition, the tank type heater is not suitable for long periods of continuous high consumption use and is not responsive to intermittent demand. The capability to respond rapidly to the heated water use or demand results in the instantaneous demand nomenclature.

U.S. Pat. No. 1,901,761 is entitled "Hot Water Heater Attachment" and discloses four embodiments of an instantaneous demand responsive gas fired hot water heater. All four embodiments disclosed utilize an external recirculation flow casing for circulating the heated water with the water temperature sensing thermostat positioned in the external casing for controlling gas flow to the burner. In all four embodiments the cold water is injected into the external casing for circulation past the water temperature sensing thermostat prior to passage into the heating coil. When flow of water is discontinued through coils and due to the thermostat location, the burner continues operation until sufficient heated water is recirculated down the recirculation casing to displace the cold water and contact the thermostat.

U.S. Pat. No. 2,974,650 is entitled "Water Heater With Side Wall Venting Means." The disclosed gas fired water heater is particularly suited for use in automobile trailers as the flue gas is safely discharged through the heater side wall. The gas burner heats an ovate reservoir tank having the thermostat located adjacent the bottom of the tank. The disclosed conventional reservoir heater is not of the instantaneous demand type, but is rather of the conventional type in sensing the water temperature in the tank.

U.S. Pat. No. 3,320,935 is an improvement of U.S. Pat. No. 2,974,650 and is entitled "Water Heater With Side Wall Air Supply and Venting Means." The disclosed hot water heater insures that all flow of air is directly to the burner and then as flue gas outwardly through the side wall vent.

3. Objects of the Present Invention

An object of the present invention is to provide a new and improved hot water heater.

A further object is to provide a new and improved instantaneous demand gas fired hot water heater.

Yet another object is to provide a new and improved instantaneous demand hot water heater that is sensitive in response to demand usage and economical in operation.

SUMMARY OF THE INVENTION

The present invention relates to new and improved instantaneous demand gas fired hot water heater. The water is heated by the gas burner when flowing upwardly in a heating coil assembly from a lower header to an upper header. The heated water temperature sensing thermostat is located in the upper or hot water discharge header casing adjacent the cold water inlet. The thermostat senses the outlet header water temperature to control the burner operation to insure proper temperature of the heated water effluent. Upon user demand, the proper temperature heated water is discharged while the cold water make up initially contacts the thermostat to immediately activate the burner element. The cold water then flows immediately from the upper header into the recycle or recirculation casing to the lower header. Upon termination of hot water demand only a small portion of the cold water needs to be displaced from the upper header into the recirculation casing before the heated water temperature is sensed by the thermostat and burner operation terminated. The internal recycle line or casing between the upper and lower headers also enables sufficient circulation of the heated water with the heater water outlet closed to prevent localized waste overheating with attendant loss of efficiency. The thermostat arrangement provides enhanced efficiency by shutting off the burner with colder water in the recycling casing and thereby avoiding unnecessary heating of the water.

BRIEF DESCRIPTION OF THE DRAWINGS

The FIGURE is a side view, in section, of an instantaneous demand hot water heater apparatus constructed in accordance with the present invention.

DESCRIPTION OF THE PREFERRED EMBODIMENT

The hot water heater apparatus, generally designated A in the FIGURE, of the present invention is of the instantaneous demand responsive type for providing hot water at a relatively high operating pressure. The disclosed water heating apparatus is not intended or designed for use as an internal steam generator, but as only a water heater. However, when the heated high pressure water is discharged, the water may flash to steam under certain conditions. Such instantaneous demand hot water heaters have a number of useful purposes one of which is providing a supply of high pressure hot water (near, but not at the boiling point) for a desired intended use such as carpet cleaning equipment.

The hot water heater apparatus A is provided with a rigid steel substantially cylindrical shell assembly 10 which forms a relatively light and compact unit. The shell assembly 10 is provided with the suitable support ring or plurality of support legs 12*a* for positioning the shell assembly 10 a suitable distance above the floor or other selected support surface F. The shell assembly 10 is assembled using any desired securing means, but metal screws that enable disassembly are preferred.

The heater shell assembly 10 includes a substantially cylindrical outer steel shell 12 and an inner shell 14. The steel inner shell 14 is concentrically disposed within and spaced from the outer shell 10. The upper end of the outer shell 12 is closed by a disc shaped upper or outer roof 16 while the inner shell 14 is closed by a disc shaped inner roof 18 that is parallel to and spaced from the upper roof 16. The lower end of the outer shell 12 is closed by a bottom plate or lower closure member 20 which is secured to the heater support ring 12*a*.

The inner shell 14 is joined to the outer shell 12 at a circumferential seam 14*a* desired distance above the bottom plate 20. The space between the inner shell 14 and the outer shell is filled with a suitable high temperature insulation 22 prior to final assembly.

Extending through the inner roof 18 and outer roof 16 is a flue gas outlet 24 than enables the flue gas or combustion products to escape from the internal heating chamber 26. Disposed below the seam 14*a* is a suitable plurality of burner openings 28 formed in the outer shell 12 for enabling passage of combustion air into the heating chamber 26. An enlarged burner opening 30 enables installing and removal of a conventional gas burner assembly 32 from the heating chamber 26 as well as providing a passage for combustion air. The gas burner assembly 32 includes the conventional pilot light flame burner (not illustrated) for igniting the gas from the burner assembly 32 as well as a pilot flame sensing thermocouple as is known in the art.

Disposed within the shell assembly 10 is a water containing heating coil assembly 34 in which the temperature of the high pressure water is elevated to the desired temperature. The heating coil includes a suitable plurality (preferably three) of nested spiral seamless copper tubing coils 36, 38 and 40. The plurality of coils 36, 38 and 40 are arranged in a multiple lead arrangement to insure uniform exposure to the flame of the burner 32 for insuring substantially even heat transfer to the water in each of the coils 36, 38 and 40. Copper is preferably employed as a material of construction to enhance the heat transfer from the burner flame to the water as known in the art. The heating coil assembly 34 further includes an upper heated water header or outlet manifold 42 communicating with the coils 36, 38 and 40 as well as a lower water feed or inlet header or manifold 44 which also communicates with the spiral coils 36, 38 and 40. During water heating operations the water preferably flows or circulates from the lower manifold 44 upwardly through the parallel coils 36, 38 40 to the upper outlet manifold 42.

A heated water outlet 46 is provided in the upper manifold 42 for enabling discharge of the heated water as desired. In practice, the water outlet 46 is preferably connected to the point of use of the heated water where a suitable flow control valve (not illustrated) is located. Also communicating with the upper manifold 42 is the high pressure make up water inlet 48 for supplying make-up water to the hot water apparatus A as heated water is withdrawn through the outlet 46. The heater coil assembly 34 further includes a heated water recirculation casing or tube 50 disposed within the annular insulation 22 of the shell 10 that also communicates the upper header 42 and the lower header 44. The recirculation casing 50 enables thermal circulation of the heated water from the upper manifold 42 back to the lower manifold 44 to prevent localized overheating or boiling of the water when the heated water outlet 46 is shut in. In addition, the casing 50 is sized to provide the desired flow path for the incoming cold water 48 to flow directly from the inlet nozzle 48 into the casing 50 to the lower header 44 for a purpose to be described more fully hereinafter.

Protruding into the upper manifold 42 adjacent the recirculation casing 50 and water inlet 48 is a water temperature sensing element or thermostat 52 mounted on a conventional gas flow controller 54. The controller 54 is mounted with the upper manifold 42 by conventional threaded engagement at 54*a* as is well known in the art. The gas flow controller 54 is connected to a fuel gas supply line 56 and a gas outlet line 58 that is operably connected at the other end to the burner assembly 32 disposed within the heating chamber 26 below the heating coil assembly 34. The gas flow controller 54 serves to automatically control the flow of the gas from inlet line 56 through the connecting line 58 to the burner assembly 32 in the usual manner. The gas flow controller 56 also provides a fuel supply for the burner pilot light and a safety thermocouple to confirm proper operation of the pilot light (neither of which is illustrated) in the known manner.

The temperature sensing element 52 senses the temperature of the water in the upper manifold 42 adjacent the recirculation casing 50. When the water temperature in the upper manifold 42 falls below a preselected value set by water temperature controller adjustment 54*b* on the controller 54 the flow of fuel gas will be enabled to the burner 48. The gas flame will heat the high pressure water in the heating coils 36, 38 and 40 in the usual manner. As the heated water circulates or flows up the coils 36, 38 and 40 into the upper header 42 and on through outlet 46 for use, make up water will enter the upper header at water inlet 48. As the cold water inlet 48 is located radially across the tubular upper header 42 from the recirculation casing 50, the desired and designed flow path of the cold water from inlet 48 is across the header 42 into the recirculation casing 50. To achieve this flow path, the water inlet line 48 is made significantly smaller than the casing 50. The larger casing 50 offers less flow resistance to the cold water which is introduced into the header 42 at a relatively high velocity by the smaller inlet line 48. The velocity of the incoming cold water tends to guide flow directly into the aligned casing 50 after flowing about temperature sensing element 52. In flowing across the temperature sensing element 52, the decrease in temperature is immediately sensed and burner 32 operation activated by controller 54. Such arrangement provides for a (near instantaneous) burner response to the introduction of cold water resulting from hot water usage. When hot water demand terminates the cold water make up is also simultaneously and instantaneously terminated. The connections of the water heating coils 36, 38 and 40 with the upper header are disposed between the heated water outlet 46 and the temperature sensing element 52 to help prevent by-passing of cold water directly to the outlet 46. The temperature sensing element 52 will sense the higher temperature water and terminate the flow of the gas by the gas flow controller 54 as soon as the upper header 42 is filled by heated water when hot water use is terminated. Thus, when the demand of hot water at the outlet 30 is terminated only sufficient recirculation of the heated water to bring the temperature of the water in the upper manifold 46 to the desired temperature is required for burner 32 operation to be terminated by the valve controller 54 in response to the temperature by the temperature sensing element 52. When flow of heated water commences at outlet 46 the cold make-up water flows inwardly through inlet 48 across temperature sensing element 52 to the casing 50 in the predetermined preferred cold water pattern. In flowing to the casing 50 the cold water flows about the temperature sensing element 52 which senses the reduced water temperature and responsive thereto open the gas valve controller 54 to enable burner operation for heating water in the coils 36, 38 and 40. The cold water will circulate down the casing 50 to the lower header 44 where it will flow upwardly through the heating coils 36, 38 and 40 saving or absorbing the heat energy released by the burner 32.

By locating the temperature sensing element 52 in the upper manifold 42 in alignment with the water inlet 48 and the recirculation casing 52 a more responsive control of the instantaneous demand hot water heater apparatus A is provided which is also more efficient in use of fuel gas. When the heated water demand terminates, only sufficient water needs to be heated to displace the cold water from the upper manifold 42 before the temperature sensing element 52 senses the higher water temperature for terminating gas flow by the gas controller 54. At that point in time the water temperature in the casing 50 and lower manifold 44 may be substantially less than the predetermined temperature sensed by the temperature sensing element 52. In the prior art, the temperature sensing element 52 was positioned such that the water in the circulation tube 50 and in the lower manifold had to reach the predetermined temperature before burner operation was terminated. Such a delay in ending burner operation was an inefficient waste of fuel and resulted in some occasions in having to reheat the hot water. A more responsive arrangement is provided by the present invention which terminates burner operation faster in response to the termination to the heated water demand than that in the prior art. In addition, the recycling or recirculation of the heated water is minimized to further conserve energy.

The foregoing disclosure and description of the invention are illustrative and explanatory therof, and various changes in the size, shape and materials, as well as in the details of the illustrated construction, may be made without departing from the spirit of the invention.

What is claimed is:

1. A hot water heater apparatus adapted for instantaneous supply of high pressure water at an elevated temperature including:

an insulated heater shell;

a water heating coil assembly disposed within said shell, said coil assembly having a lower water supply manifold and an upper water outlet manifold;

a recirculating tube disposed in said shell for communicating said upper manifold and said lower manifold for enabling circulating flow of water from said upper manifold to said lower manifold;

said upper manifold having a water outlet for supplying heated water from the apparatus as desired;

a gas burner disposed in said shell adjacent said lower manifold for heating the water in said heating coil assembly;

a gas supply conduit supplying gaseous fuel to said burner;

valve means mounted in said gas supply conduit for controlling the supply of gas to said burner;

said upper manifold having a water inlet spaced from said water outlet for introducing unheated water to said upper manifold, said water inlet aligned with said recirculation tube to enable preferred flow of the unheated water in a flow path across said upper manifold into said recirculating tube; and a temperature sensing element disposed in said upper manifold in the preferred flow path of unheated water to enable immediate sensing of the supplied unheated water, said temperature sensing element sensing the heated water in the upper manifold upon displacement of the cold water from said upper manifold into said recirculating tube temperature after the heated water demand is terminated; and means connected said temperature sensing element to said valve means to control the flow of fuel to said burner in response to the water temperature sensed by said temperature sensing element.

2. The hot water heater apparatus as set forth in claim 1, wherein:

said heating coil assembly includes a multiple lead helical coil for heating the water.

3. The hot water heater apparatus as set forth in claim 1, wherein:

said upper manifold is formed by a substantially straight tubular conduit having a first end and a second end, said temperature sensing element installed at said first end and said hot water outlet located at said second end;

said water inlet and said recirculating tube located on said upper manifold tube to provide a desired flow across said upper manifold with said temperature sensing element temperature sensing element disposed in said desired direct flow path.

4. The hot water heater apparatus as set forth in claim 1, wherein:

said recirculation tube is dimensioned to provide a minimum of flow resistance to the entry of the unheated water for preferably flowing the unheated water to said lower manifold.

5. The hot water heater apparatus as set forth is claim 4, wherein:

said unheated water inlet is disposed above said recirculation tube to enable the unheated water to flow downwardly about said temperature sensing element into said recirculation tube.

6. The hot water heater apparatus or set forth in claim 4, wherein:

said unheated water inlet is aligned with said recirculation tube and dimensioned for flowing the unheated water with sufficient velocity in the desired flow path in said upper header to enter said recirculation tube.

* * * * *